United States Patent [19]

Liebman et al.

[11] 3,960,217

[45] June 1, 1976

[54] PASSIVE EXPLOSION BARRIER

[75] Inventors: Israel Liebman, Library; John Corry, Elrama, both of Pa.

[73] Assignee: The United States of America as represented by the Secretary of the Interior, Washington, D.C.

[22] Filed: Oct. 14, 1975

[21] Appl. No.: 622,343

[52] U.S. Cl. ..... 169/64; 169/29

[51] Int. Cl.[2] ..... A62C 35/04

[58] Field of Search ..... 239/208, 209; 169/54, 169/62, 70, 64, 57, 46, 47, 56, 60, 45, 26, 29

[56] References Cited

UNITED STATES PATENTS

| | | | |
|---|---|---|---|
| 2,352,378 | 6/1944 | Geertz | 169/45 X |

FOREIGN PATENTS OR APPLICATIONS

| | | | |
|---|---|---|---|
| 325,225 | 9/1920 | Germany | 169/64 |
| 325,227 | 9/1920 | Germany | 169/64 |
| 326,186 | 9/1920 | Germany | 169/64 |
| 212,896 | 7/1924 | United Kingdom | 169/56 |
| 506,606 | 6/1939 | United Kingdom | 169/60 |

*Primary Examiner*—Robert S. Ward, Jr.
*Attorney, Agent, or Firm*—Gersten Sadowsky; Donald R. Fraser

[57] ABSTRACT

A passive explosion barrier for suppressing the effects of an explosion in a mine gallery, or the like, comprises a receptacle containing an explosion suppressing substance adapted to be supported by framework adjacent the mine roof. In one embodiment, a corrugated face plate is hinged to the base of the receptacle on one side thereof. First and second support flanges are formed respectively on the upper end of the face plate and on the rim of the receptacle on the side thereof opposite the plate. The receptacle is mounted to the framework with the support flanges resting on first and second beams and with the face plate viewing the explosion source and oblique to a horizontal plane. The weight of the receptacle, and friction between the face plate flange and first beam, prevent the receptacle from releasing due to accidental disturbances. However, the force of wind accompanying an explosion acts against the face plate, causing it to both lift from the first beam and pivot toward the receptacle. As this occurs, the receptacle slips from the first beam and spills the suppressing substance into the path of the explosion. Wind force also maintains the receptacle flange temporarily in contact with the second beam. This imparts rotation to the receptacle as it falls to the ground for thorough dispersion of the suppressing substance. In another embodiment, a pair of face plates are hinged to opposite sides of the receptacle for bidirectional operation.

12 Claims, 9 Drawing Figures

PASSIVE EXPLOSION BARRIER

BACKGROUND OF THE INVENTION

The present invention relates generally to explosion barriers for mines, or the like, and more particularly to a passive explosion barrier that is responsive to relatively low velocity, as well as intermediate and high velocity explosion generated wind, but is not responsive to relatively small accidental disturbances.

In order to suppress the effects of an explosion in an underground coal mine, explosion barriers are presently employed to launch explosion suppression substances, such as water, into the path of the explosion. The explosion suppressing substance tends to cool the hot gases and avoid the spreading of coal dust ignition.

The types of explosion barriers are generally classified as being either (a) triggered or (b) passive.

Triggered barriers typically use optical and/or electronic devices to sense the flame accompanying an explosion and set off explosives or open high pressure containers to rapidly expel the explosion suppressing substance. These devices are extremely fast and are capable of setting off the barrier even before the pioneer wave of the explosion reaches the barrier. This is done by mounting the sensor between the barrier and explosion source. While generally satisfactory, triggered barriers are expensive and require a substantial amount of maintenance to insure their operation.

Passive barriers typically comprise a receptacle containing the explosion suppressing substance, such as water or dust, located on a shelf adjacent the mine roof. The shelf is formed by constructing a receiving platform beneath the mine roof. The barrier is mounted by raising the receptacle above the platform and then dropping the receptacle into the platform from above. This requires the platform to extend substantially below the mine roof and diminishes head room, especially in low roof mine galleries.

In operation, the receptacle is blown off the platform by the strong air current which precedes an explosion. The receptacle drops from the platform disbursing its contents into the path of the explosion.

While generally somewhat satisfactory for explosions causing moderate to high wind speeds (in excess of 250 ft./sec.), passive barriers are ineffective in suppressing slow moving explosions. The slow moving wind is not capable of spilling the contents of the barrier. Accordingly, the presently used passive barriers are generally located no nearer than approximately 160 ft. from the explosion source.

OBJECTIVES OF THE INVENTION

Accordingly, it is one object of the present invention to provide a new and improved passive explosion barrier.

It is another object of the present invention to provide a passive explosion barrier that is responsive to relatively low velocity wind, yet is not triggered by relatively small accidental disturbances.

It is another object of the present invention to provide a passive explosion barrier that thoroughly disperses an explosion suppression substance in the path of the explosion.

It is another object of the present invention to provide a passive explosion barrier that occupies a minimal amount of head room in the mine.

It is still another object of the present invention to provide a passive explosion barrier that is easy to install adjacent the mine roof.

BRIEF DESCRIPTION OF THE PREFERRED EMBODIMENTS

Briefly, in accordance with the invention, a passive explosion barrier comprises a receptacle containing an explosion suppressing substance mounted on a pair of beams adjacent the mine roof with a pair of support flanges. The first flange is formed on the upper edge or rim of one side of the receptacle. The other flange is formed on the upper edge of a face plate hinged to the base of the receptacle on the side thereof opposite the first flange. With the barrier mounted on the beams, the face plate is angled away from the receptacle, oblique to a horizontal plane. Friction between the face plate flange and beam prevents the flange from slipping from the beam due to accidental disturbances. However, wind generated by an explosion, acting against the face plate, creates force components tending to both lift the plate and pivot it against the receptacle. The lift reduces the friction between the face plate flange and beam causing the face plate to more easily pivot against the receptacle and slip from the beam or "trigger" in response to relatively low velocity wind.

More specifically, in one embodiment the receptacle is a conventional passive barrier having a rectangular base with four upstanding sides. The upper end of the receptacle is open to receive the explosion suppressing substance. The flange formed on the receptacle extends along the entire upper edge or rrim of one side. The face plate, hinged to the base of the receptacle on the opposite side thereof, extends upwardly to the rim. The face plate is formed of a relatively thin sheet of light material, such as polyvinyl chloride. The sheet stock is preferably one-eighth inch thick and vertically corrugated on one-half inch centers for rigidity. A receptacle constructed in accordance with the preferred embodiment is advantageously responsive to a wind velocity as low as approximately 50 ft./sec. Commercially available prior art devices known to us require wind velocity of approximately 250 ft./sec. to activate.

A horizontal member is formed on the upper end of the face plate. One portion of the member constitutes the face plate support flange, while another portion abuts the upper rim of the receptacle for stabilizing the receptacle when it is installed in the framework.

The explosion barrier is installed by raising the receptacle between the first and second beams adjacent the mine roof. Then the face plate is swung away from the side of the receptacle and the receptacle is slightly lowered until the flanges rest on the beams. The weight of the receptacle and contents, and friction between the face plate flange and the first beam, prevent the face plate from accidentally triggering. Since the face plate is oblique to a horizontal plane, first and second force components caused by explosion generated wind are exerted on the plate tending to both lift the face plate flange from the first beam and pivot the plate against the receptacle. The first force component tends to raise the face plate flange above the first beam. This separates the face plate flange and first beam, and reduces friction therebetween. The second force component tends to pivot the face plate toward the receptacle until the face plate flange slips from the first beam (triggers). When this happens, one side (face plate side) of the receptacle drops from the first beam. However, horizontal wind flow maintains the opposite side of the receptacle against the second beam so that the receptacle tends to rotate about that beam, thoroughly dispersing its contents as the receptacle falls freely to the floor of the mine.

In another embodiment, a hinged face plate is provided on each of opposite sides of the receptacle for response to explosions occurring on either of said opposite sides of the receptacle.

In some applications where there are substantial normal disturbances or likelihood of accidental triggering of the explosion barrier, the friction between the face plate flange and beam is increased by placing on the flange a thin strip of material, such as neoprene, that has a relatively high coefficient of friction with the beam. This further prevents the face plate flange from slipping from the beam due to accidental disturbances. However, when there is an explosion, the lifting force component of the wind reduces the effect of the increased friction.

Still other objects and advantages of the present invention will become readily apparent to those skilled in the art from which the following detailed description, wherein we have shown and described only the preferred embodiments of the invention, simply by way of illustration of the best mode contemplated by us of carrying out our invention. As will be realized, the invention is capable of other and different embodiments, and its several details are capable of modification in various obvious respects, all without departing from the invention. Accordingly, the drawing and description are to be regarded as illustrative in nature, and not as restrictive.

DETAILED DESCRIPTION OF THE PREFERRED EMBODIMENTS

Figure 1:
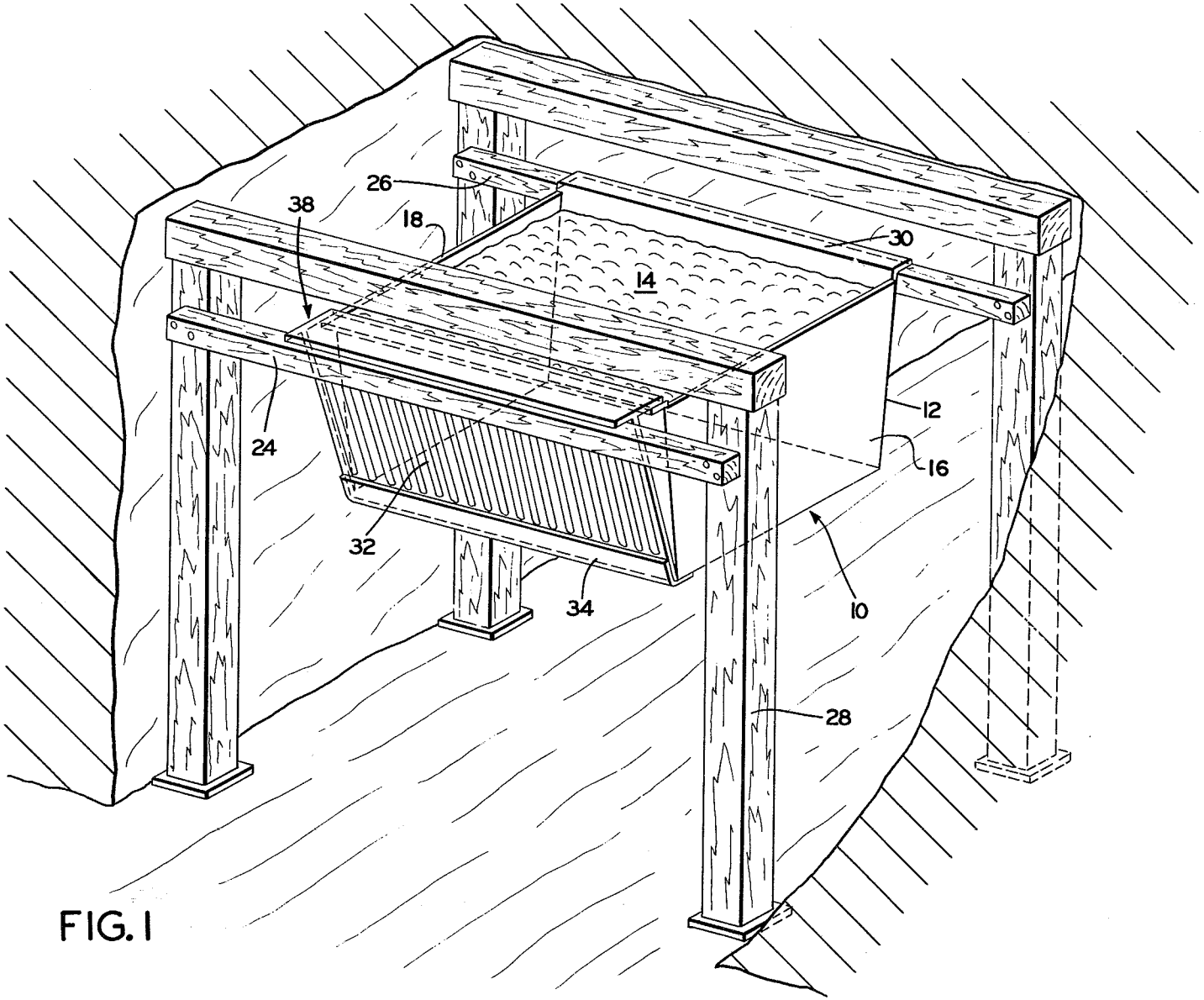
FIG. 1 is a perspective view of one embodiment of the passive explosion barrier mounted to a pair of beams adjacent the roof of a mine.
Figure 2:
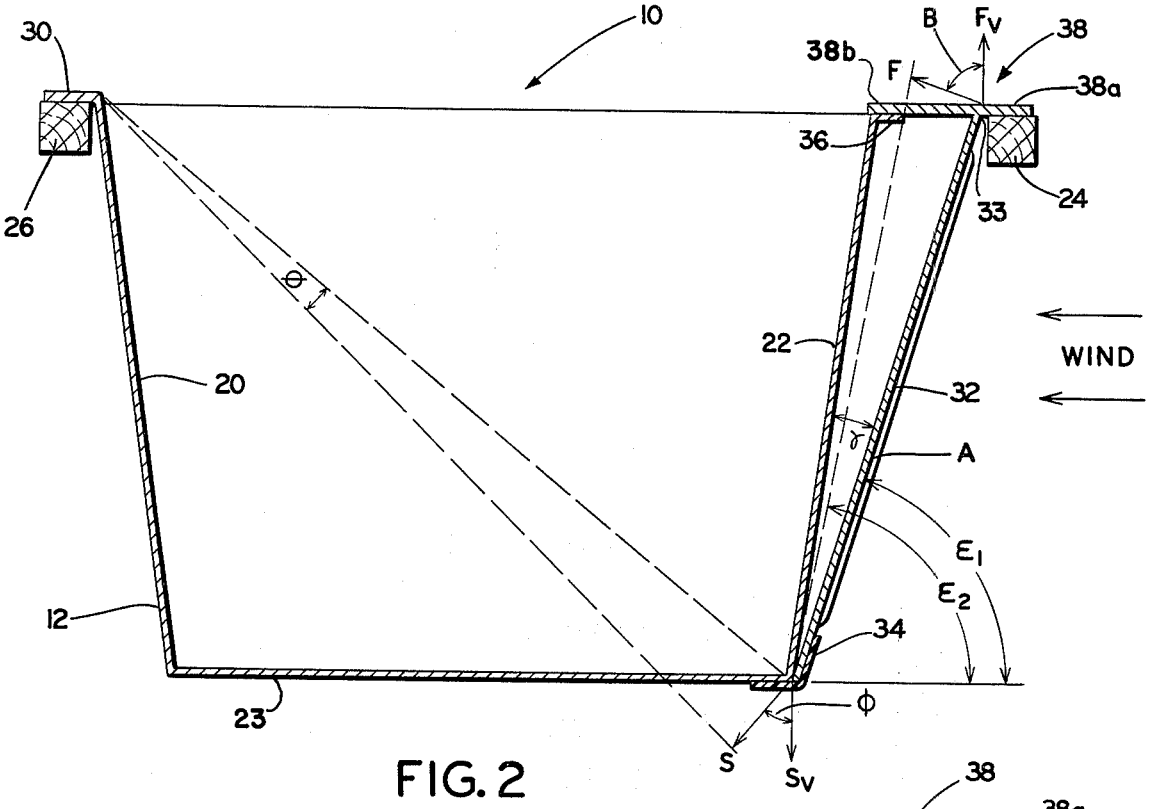
FIG. 2 is a cross-sectional side view of the passive barrier shown in FIG. 1.

Referring to FIGS. 1 and 2, a passive explosion barrier 10, in accordance with the present invention, comprises a receptacle 12 containing an explosion suppressing substance 14, such as water. Receptacle 12 is preferably formed of a lightweight material, such as polyvinyl chloride and includes four upstanding sides 16, 18, 20 and 22 forming a rectangular parallelepiped with the upper end being open for receiving substance 14.

Receptacle 12 is mounted to a pair of support beams 24 and 26 adjacent the roof of the mine. Support beams 24 and 26 are attached to props 28; however the beams may be supported adjacent the roof by any suitable means, such as conventional mine roof suspension bolts.

A first support flange 30 is integrally formed along the upper edge of side 20 and extends outwardly therefrom for mounting the receptacle on beam 26. A corrugated face plate 32 is pivotally mounted to the other side 22 adjacent base 23 with hinge 34. Face plate 32 is formed of lightweight sheet stock, such as polyvinyl chloride. The thickness of the sheet stock is preferably one-eighth inch and the stock is vertically corrugated on one-half inch centers for rigidity as shown in FIG. 1.

Face plate 32 extends upwardly toward another flange 36 integrally formed along the upper edge of side 22 of receptacle 12. A horizontal member 38 is formed along the upper edge 33 of face plate 32 comprising portions **38*a* and 38*b* extending outwardly from the edge in opposite directions. Portion 38*a* functions as a support flange for mounting receptacle 12 on beam 24, while portion 38*b* located on flange 36, stabilizes receptacle 12 when it is mounted in position on beams 24 and 26. The distance $D_1$ between the upper edge 33 of face plate 32 and flange 36 is larger than the distance $D_2$ between edge 33 and outer edge 35 of support flange 38*a* (see also FIG. 3A). This is to insure enough clearance between face plate 32 and flange 36 to permit flange 38*a* to slip from beam 24** during triggering, as described in more detail below.

Passive explosion barrier 10 is mounted to beams 24 and 26 from below by first rotating face plate 32 toward side 22. The receptacle 12 is then raised between beams 24 and 26 until support flanges 30 and **38*a* are located over the beams. Face plate 32 is rotated away from side 22 until flanges 30 and 38*a* extend respectively over beams 26 and 24 and receptacle 12 is lowered with support flanges 30 and 38*a* resting on the beams. After mounting, receptacle 12** is filled with water, or other explosion suppressing substance.

Referring to FIG. 2, receptacle 12, shown in cross-sectional side view, is located in place on beams 24 and 26. Side 20 of receptacle 12 is mounted on beam 26 with support flange 30, while face plate 32, pivoted away from side 22, is mounted on beam 24 with support flange **38*a*. Portion 38*b* of horizontal member 38 is maintained against flange 36 of receptacle 12** by the weight of the receptacle and contents.

With receptacle 12 mounted as shown, face plate 32 is oblique to a horizontal plane at an angle $\epsilon_1$. The weight of receptacle 12 and contents, creates a relatively high friction force to exist between support flanges 30 and **38*a* and beams 24 and 26. The friction between flange 38*a* and beam 24 prevents face plate 32 from sliding toward side 22 due to low intensity or accidental disturbances. During an explosion, horizontal wind, impinging the oblique face plate 32 exerts vertical, as well as horizontal force components. As discussed in more detail in the following paragraphs, the vertical force component, tending to rotate face plate 32 counterclockwise about hinge 34, reduces the static friction between flange 38*a* and beam 24, while the horizontal component pivots face plate 32 toward side 22 until the face plate forms an angle $\epsilon_2$ (approximately 90°) with the horizontal plane. When this happens, receptacle 12 releases or "triggers" from beam 24 and side 22 begins to drop. Horizontal wind flow maintains flange 30 temporarily in contact with beam 26 imparting rotation of the receptacle as it falls to thoroughly disperse substance 14 in the path of the explosion. The lightweight, corrugated face plate 32** makes the inventive device sensitive to explosive wind velocity as low as approximately 50 ft./sec., which is more than a three-fold sensitivity improvement over known prior art passive barriers.

Figure 3A:
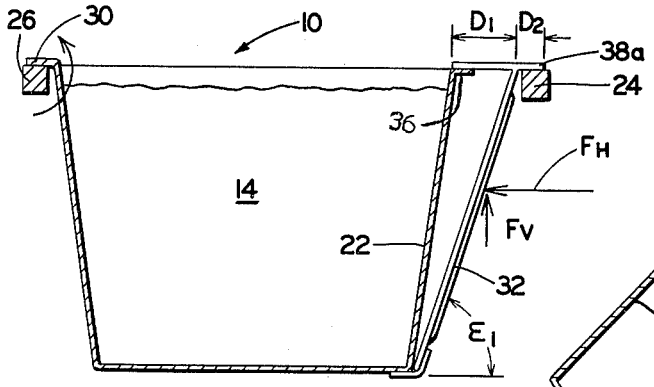
FIGS. 3A–3E are cross-sectional side views of the passive barrier of FIG. 1 illustrating the operation thereof.
Figure 3D:
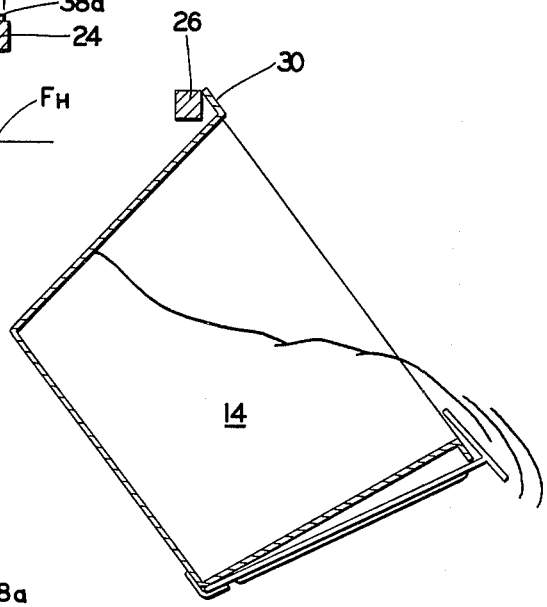

Referring now to FIGS. 3A–3E, the operation of explosion barrier 10 will be described in more detail. FIG. 3A shows explosion barrier 10 mounted in position on beams 24 and 26 by support flanges 30 and 38*a*, respectively. Horizontal wind forces generated by an explosion, represented by vector $F_H$, impinge the oblique surface of face plate 32. The oblique orientation of face plate 32 creates a vertical force component, represented by $F_V$, tending to rotate face plate 32 counterclockwise about hinge 34. As this happens, support flange 38*a* lifts slightly from beam 24 reducing the effect of friction therebetween.

Figure 3B:
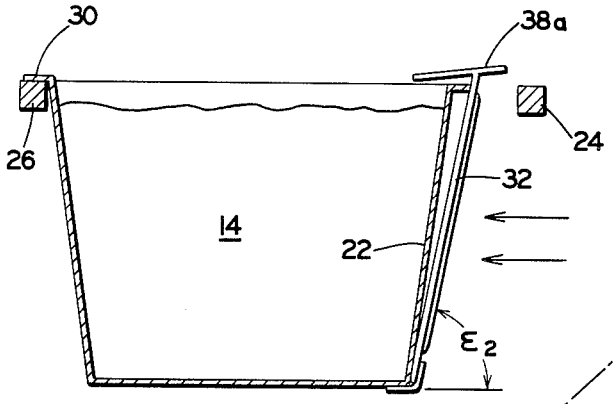
Figure 3E:
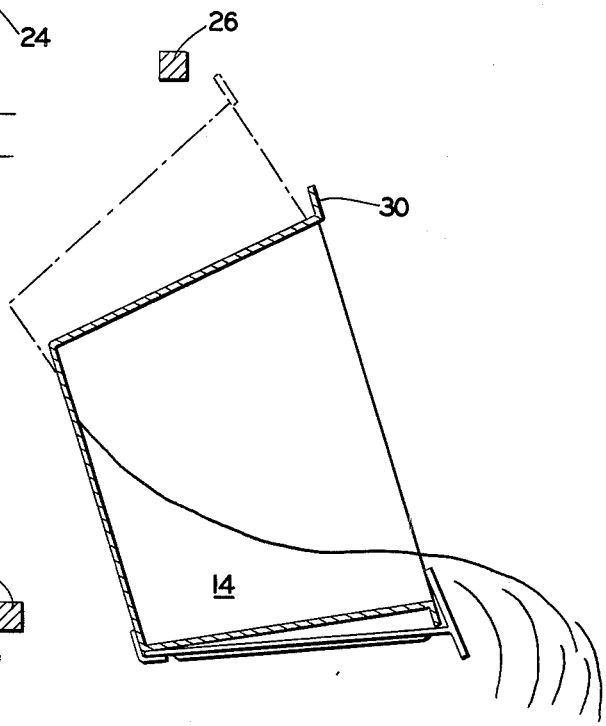
Figure 3C:
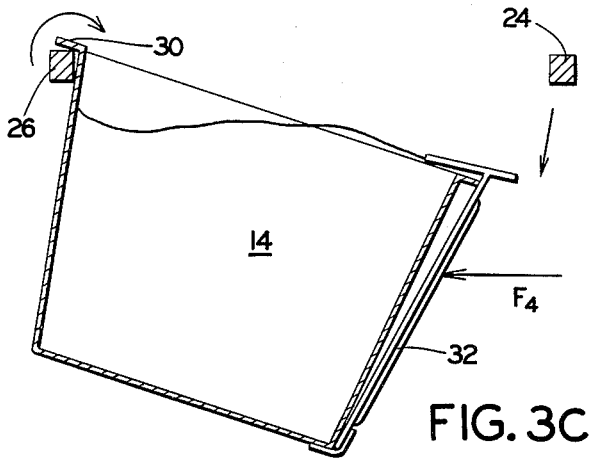

With friction between support flange 38*a* and beam 24 reduced, the horizontal wind flow pivots face plate 32 toward side 22, as shown in FIG. 3B. Face plate 32 pivots toward side 22 until the plate abuts flange 36 formed on receptacle 12. Since distance $D_1$ (between face plate 32 and flange 36 is greater than distance $D_2$ (width of flange 38*a* ), the face plate pivots between angle $\epsilon_1$ and angle $\epsilon_2$ to release support flange 38*a* from beam 24, and one side of receptacle 12 begins to fall (see FIG. 3C).

As receptacle 12 falls from beam 24, force component $F_H$, exerted on face plate 32, maintains flange 30 temporarily in abutment with beam 26. Side 22 of receptacle 12 falls from beam 24, and a rotating action is imparted to the receptacle as flange 30 pivots about beam 26 (see also FIG. 3D). As side 22 of receptacle 12 continues to fall, explosion suppressing substance 14 begins to spill from the receptacle into the path of the explosion.

Finally, as receptacle 12 approaches a vertical orientation, flange 30 falls naturally from beam 26 causing additional spillage of the substance 14. The rotating action of receptacle 12, as it drops from beams 24 and 26, thoroughly disperses the substance 14 and prevents "voids" from occurring in the path of the flame. Furthermore, since explosion barrier 10 is responsive to relatively low velocity wind, it is effective even if located within about 75 feet of an explosion source.

Referring again to FIG. 2, the acceleration effects of the vertical and horizontal components of wind force acting on face plate 32 are described. The force of gravity on receptacle 12 results in a torque $L_1$ about beam 26 as follows:

$$L_1 = I_1 \frac{d^2\theta}{dt^2} = C_1 m_1 g \qquad (1)$$

where:

$I_1$ is the moment of inertia of receptacle 12 about beam 26,
$t$ is the time,
$C_1$ is the horizontal distance from beam 26 to the receptacle center of gravity,
$m_1$ is the mass of receptacle 12 and contents, and
$g$ is gravity force.

The acceleration of hinge 34 about beam 26 is therefore:

$$I_1 \frac{d^2\theta}{dt^2} = \frac{d^2S}{dt^2} \qquad (2)$$

The vertical component of the above acceleration is:

$$\frac{d^2S_v}{dt^2} = \frac{d^2S}{dt^2} \cos\phi \qquad (3)$$

The wind forces on face plate 32 result in a torque $L_2$ about hinge 34 as follows:

$$L_2 = I_2 \frac{d^2\gamma}{dt^2} + C_2 m_2 g = \frac{1}{2} C_D A^1 \rho v^2 \frac{h}{2} \qquad (4)$$

where:

$I_2$ is the moment of inertia of face plate 32 about hinge 34,
$C_2$ is the horizontal distance from the hinge to the center of gravity of the face plate,
$m_2$ is the mass of the face plate,
$C_D$ is the drag coefficient,
A is the vertically projected area of the face plate,
$\rho$ is the air density,
$v$ is the wind velocity, and
$h$ is the vertically projected height of face plate 32.

The acceleration of flange 38*a* about hinge 34 is therefore:

$$I_2 \frac{d^2\gamma}{dt^2} = \frac{d^2F}{dt^2} \qquad (5)$$

The vertical component of the acceleration of flange 38*a* is:

$$\frac{d^2F_v}{dt^2} = \frac{d^2F}{dt^2} \cos\beta \qquad (6)$$

If $d^2F_v/dt^2 \geq d^2S_v/dt^2$(Mode 1), the weight of barrier 10 acting to hold flange 38*a* down on beam 24 is fully offset and flange 38*a* lifts from beam 24 as the flange swings toward side 22. Even if $d^2F_v/dt^2 < d^2S_v/dt^2$(Mode 2), the vertical component ($d^2F_v/dt^2$) serves to reduce the force of the barrier holding flange 38*a* to beam 24, and thereby reduces the amount of wind force required to slide flange 38*a* along beam 24. Mode 2 is effective during relatively low wind speeds when the coefficient of friction between flange 38*a* and beam 24 is small, whereas, Mode 1 occurs during relatively high wind speeds when the coefficient of friction between flange 38*a* and beam 24 is large. We have found that barrier 10 filled with 180 lbs. of water responds to wind speeds of about 50 ft./sec. when the coefficient of friction between flange 38*a* and beam 24 is 0.5; and to wind speeds of about 80 ft./sec. when the coefficient of friction is 1.0.

Figure 5:
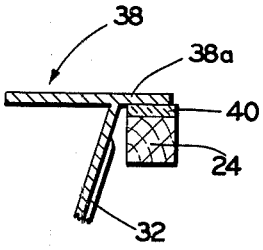
FIG. 5 is an enlarged partial cross-section of an alternative form of the supporting flange of the barrier.

Sensitivity of explosion barrier 10 to accidental triggering by jarring face plate 32 was examined by measuring the amount of horizontal force necessary to move flange 38*a* off beam 24 when applied at the approximate center of face plate 32. With barrier 10 filled with 180 lbs. of water, and the coefficient of friction between flange 38*a* and beam 24 being 0.5, a horizontal force of 15 to 20 lbs. is needed to move flange 38*a*. However, the addition of material 40 (FIG. 5) such as neoprene tape which raises the coefficient of friction to 1.0, increases the required force to 60 to 75 lbs.

Figure 4:
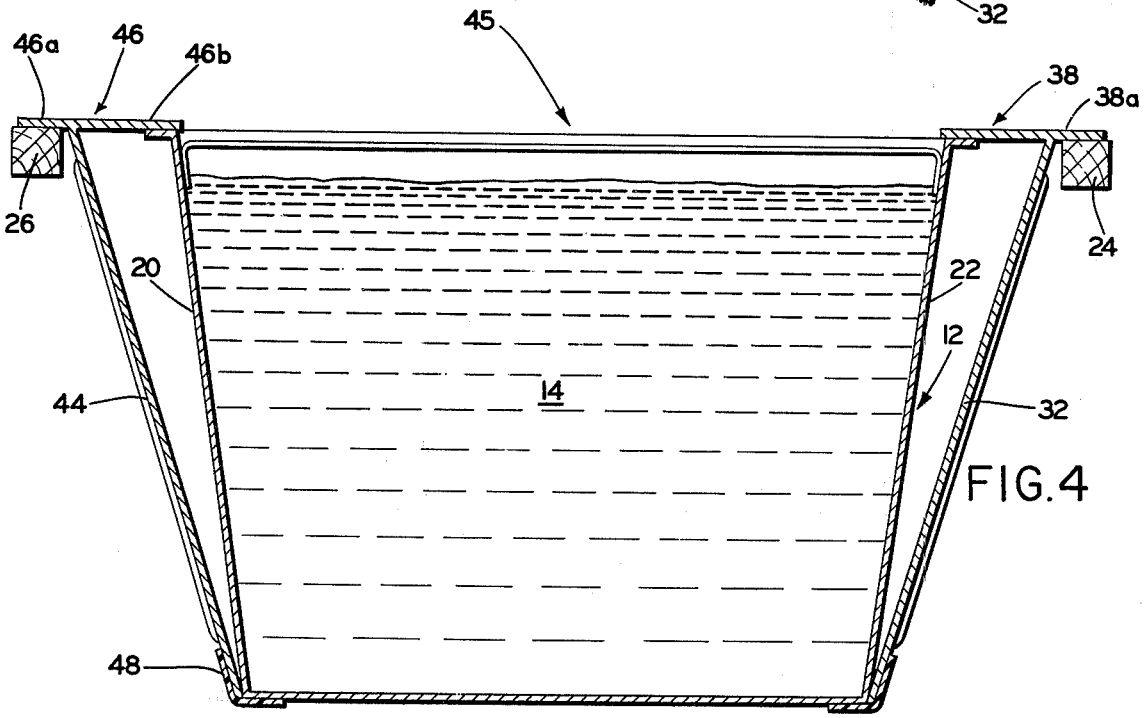
FIG. 4 is a cross-sectional side view of another embodiment of the passive explosion barrier.

Referring to FIG. 4, a modified version of explosion barrier 10 is shown. Barrier 45 in FIG. 4 is similar to barrier 10, shown in FIG. 2, with the addition of a second face plate 44. At the upper end of face plate 44, horizontal member 46 comprises a first portion 46*a*, constituting a support flange, and a second portion 46*b*, constituting a stabilizer, similar to portions 38*a* and 38*b* on horizontal member 38. Face plate 44 is attached to the lower end of side 20 with a hinge 48. Explosion barrier 45 is mounted to beams 24 and 26 by support flanges 38*a* and 46*a* by raising the receptacle 12 up between the beams and then pivoting both face plates 44 and 32 outwardly from receptacle 12 until the support flanges are located over said beams.

The operation of explosion barrier 45 is similar to that of explosion barrier 10. Most importantly, however, barrier 45 is responsive to wind flow in either of two opposite directions through the mine gallery. Wind flow originating from an explosion to the left of receptacle 12 applies vertical and horizontal force components against face plate 44. The vertical force component causes vertical separation between beam 26 and flange 46*a*, while the horizontal force component causes face plate 44 to pivot toward receptacle 12 triggering the barrier 45. There is substantially no pivoting of face plate 32 because the weight of receptacle 12 maintains stabilizer portion 38*b* of horizontal member 38 in firm abutment with flange 36. This is because horizontal member 38 tends to rotate counterclockwise about beam 24 against flange 36.

In a same manner, wind flow originating from an explosion to the right of receptacle 12 acts against face plate 32. Vertical and horizontal force components, applied to face plate 32, gently separate flange 38*a* from beam 24 and pivot the plate toward receptacle 12 for triggering of the explosion barrier 45.

While we have shown and described two preferred embodiments of the present invention, it is to be understood that numerous variations and modifications of the invention could be made without departing from the spirit thereof. For example, while the explosion suppressing substance 14 has been specified as being water, it is to be understood that other substances could be used. Also, other materials forming receptacle 12 and face plates 32 and 44 could be used, such as aluminum. Other cross-sectional forms of face plates 32, 44, such as planar, are contemplated also. However, to gain the requisite strength and rigidity with planar stock, at least one-quarter inch thickness is required.

What is claimed is:

1. Apparatus mountable to first and second spaced apart beams adjacent a mine roof for suppressing explosions, comprising:

a receptacle for storing an explosion suppressing substance, one side of said receptacle having a first support flange for mounting said one side on said first beam;

a face plate pivotally attached to the opposite side of said receptacle, said plate having a second support flange for mounting said opposite side on said second beam;

said face plate being pivotable from a first position to a second position in response to wind forces of an explosion;

said face plate forming a first angle with a horizontal plane in said first position, wherein said first and second support flanges are separated from each other by a first distance sufficient for mounting said flanges respectively on said first and second beams; and said face plate forming a second angle with the horizontal plane in said second position, said second angle being larger than said first angle, wherein said first and second support flanges are separated from each other by a second distance insufficient for mounting said flanges respectively on said first and second beams, said receptacle spilling said suppressing substance in the path of the explosion.

2. The apparatus of claim 1 wherein said face plate forms an oblique angle with respect to the horizontal plane in the first position, whereby horizontal wind forces generated by explosion tend to lift said second flange from said second beam and pivot said face plate to said second position.

3. The apparatus of claim 1 wherein a surface of said face plate is corrugated for rigidity.

4. The apparatus of claim 2 wherein said face plate is oriented approximately vertically in said second position.

5. The apparatus of claim 1 including a material disposed between said face plate support flange and said second beam, the coefficient of friction between said material and said second beam being larger than the coefficient of friction between said face plate support flange and said second beam.

6. Apparatus mountable to first and second spaced apart beams adjacent a mine roof for suppressing explosions, comprising:

a receptacle for storing an explosion suppressing material;

first and second face plates pivotally attached respectively to opposite sides of said receptacle, each of said plates having a support flange formed thereon for mounting said plates respectively on said first and second beams;

each of said face plates being pivotable from a first position to a second position in response to the force of wind generated by an explosion, each of said face plates forming a first angle with a horizontal plane in said first position, said flanges being separated from each other by a distance sufficient for mounting said flanges respectively on said first and second beams;

each of said face plates forming a second angle with the horizontal plane in a second position, said second angle being larger than said first angle; and said receptacle being released from said beams in response to either of said first and second face plates being pivoted into said second position.

7. A passive explosion barrier mountable to first and second spaced apart beams adjacent a mine roof, comprising:

a receptacle for storing an explosion suppressing substance, one side of said receptacle having a first support flange for mounting said side on said first beam;

a face plate pivotally attached to the opposite side of said receptacle, said plate having a second support flange for mounting said opposite side on said second beam;

said face plate forming a first oblique angle with a horizontal plane in a first position, said first and second flanges spaced apart from each other by a distance sufficient for mounting said flanges respectively on said first and second beams, static friction formed between said second flange and said second beam preventing accidental pivoting of said face plate;

said oblique face plate being pivoted toward said opposite side of said receptacle under the force of horizontal wind flow against said face plate, said wind flow providing force components for lifting said second flange from said second beam reducing said static friction therebetween, and pivoting said face plate toward said opposite side of said receptacle, the pivoting of said face plate releasing said opposite side of said receptacle from said second beam, said wind force temporarily maintaining said first flange in contact with said first beam to impart rotation to said receptacle.

8. A passive explosion barrier mountable in a passage comprising:

a receptacle for storing an explosion suppressing substance;

means for supporting said receptacle in said passage including a relatively slidable flange and support member;

plate means oblique to a horizontal plane for releasing said receptacle from said support means to disperse said substance, whereby when wind generated by an explosion impinges said oblique plate means vertical and horizontal force components are created, said force components reducing the coefficient of friction between said flange and support member and generating sliding action therebetween sufficient to disengage said flange from said support member.

9. The apparatus of claim 8 including means for pivotally attaching said plate means to said receptacle, said flange being formed on said plate means and extending outwardly from said receptacle for mounting on said support member.

10. The apparatus of claim 9 wherein said attaching means includes a hinge attached between said plate means and a lower portion of said receptacle.

11. The apparatus of claim 8 wherein said plate means is corrugated for rigidity.

12. The apparatus of claim 9 wherein said supporting means includes means extending between said plate means and said receptacle for stabilizing said receptacle when said receptacle is mounted in said passage.

* * * * *